US008135107B2

(12) United States Patent
Singh et al.

(10) Patent No.: US 8,135,107 B2
(45) Date of Patent: Mar. 13, 2012

(54) CANISTER APPARATUS AND BASKET FOR TRANSPORTING, STORING AND/OR SUPPORTING SPENT NUCLEAR FUEL

(75) Inventors: Krishna P. Singh, Jupiter, FL (US); Stephen J. Agace, Marlton, NJ (US)

(73) Assignee: Holtec International, Inc. (US)

( * ) Notice: Subject to any disclaimer, the term of this patent is extended or adjusted under 35 U.S.C. 154(b) by 0 days.

(21) Appl. No.: 11/851,352

(22) Filed: Sep. 6, 2007

(65) Prior Publication Data

US 2008/0069291 A1 Mar. 20, 2008

Related U.S. Application Data

(60) Provisional application No. 60/842,868, filed on Sep. 6, 2006.

(51) Int. Cl.
*G21C 19/00* (2006.01)
*G21F 5/00* (2006.01)

(52) U.S. Cl. ..... 376/272; 250/506.1; 250/507.1

(58) Field of Classification Search ..... 250/507.1, 250/506.1
See application file for complete search history.

(56) References Cited

U.S. PATENT DOCUMENTS 4,800,283 A * 1/1989 Efferding ..... 250/507.1
4,972,087 A * 11/1990 Neider et al. ..... 250/507.1
5,438,597 A * 8/1995 Lehnert et al. ..... 376/272
6,823,034 B1 * 11/2004 Doman ..... 376/272
7,186,993 B2 * 3/2007 Timpert ..... 250/507.1
2003/0002614 A1 * 1/2003 Matsunaga et al. ..... 376/272
2003/0010938 A1 * 1/2003 Michels et al. ..... 250/507.1

FOREIGN PATENT DOCUMENTS

JP 2004156930 A * 6/2004

OTHER PUBLICATIONS

Survey of Wet and Dry Spent Fuel Storage, Printed by IAEA Jul. 1999, Austria.*
Ohsono et al., machine translation.*
Kenneally, R. and Kessler, J., Behavior of Spent Fuel and Safety-Related Components in Dry Cask Storage Systems, Aug. 2001, pp. 1-8.*
Ohsono et al., machine translation, Jun. 2004.*

* cited by examiner

*Primary Examiner* — Rick Palabrica
*Assistant Examiner* — Erin M Leach
(74) *Attorney, Agent, or Firm* — The Belles Group, P.C.

(57) ABSTRACT

A canister apparatus, basket apparatus and combinations thereof for transporting and/or storing high level radioactive waste, such as spent nuclear fuel. The canister apparatus comprises a cavity for receiving the spent nuclear fuel that is surrounded by two independent gas-tight containment boundaries. The structures that form the two independent gas-tight containment boundaries are in substantially continuous surface contact with one another, thereby facilitating sufficient heat removal from the cavity. In another aspect, the invention is a basket apparatus having a plurality of disk-like grates arranged in a stacked and spaced arrangement so that the cells of the disk-like grates are aligned. In still another aspect, the invention can be a basket apparatus having a disk-like grate having a ring-like structure encompassing a gridwork of beams specially arranged to achieve a unique cell configuration.

29 Claims, 9 Drawing Sheets

CANISTER APPARATUS AND BASKET FOR TRANSPORTING, STORING AND/OR SUPPORTING SPENT NUCLEAR FUEL

CROSS-REFERENCE TO RELATED APPLICATIONS

The present invention claims priority to U.S. Provisional Patent Application No. 60/842,868, filed Sep. 6, 2006, the entirety of which is hereby incorporated by reference.

FIELD OF THE INVENTION

The present invention relates generally to the field of storing and/or transporting high level waste, such as spent nuclear fuel rods, and specifically to apparatus and methods of storing and/or transporting spent nuclear fuel rods in a dry and hermetically sealed state.

BACKGROUND OF THE INVENTION

In the operation of nuclear reactors, hollow zircaloy tubes filled with enriched uranium, known as fuel assemblies, are burned up inside the nuclear reactor core. It is necessary to remove these fuel assemblies from the reactor after their energy has been depleted to a predetermined level. Upon depletion and subsequent removal from the reactor, these spent nuclear fuel ("SNF") rods are still highly radioactive and produce considerable heat, requiring that great care be taken in their subsequent packaging, transporting, and storing. Specifically, the SNF emits extremely dangerous neutrons and gamma photons. It is imperative that these neutrons and gamma photons be contained at all times subsequent to removal from the reactor core.

In defueling a nuclear reactor, the SNF is removed from the reactor and placed under water, in what is generally known as a spent fuel pool or pond storage. The pool water facilitates cooling of the SNF and provides adequate radiation shielding. The SNF is stored in the pool for a period of time that allows the heat and radiation to decay to a sufficiently low level so that the SNF can be transported with safety. However, because of safety, space, and economic concerns, use of the pool alone is not satisfactory where the SNF needs to be stored for any considerable length of time. Thus, when long-term storage of SNF is required, it is standard practice in the nuclear industry to store the SNF in a dry state subsequent to a brief storage period in the spent fuel pool. Dry storage of SNF typically comprises storing the SNF in a dry inert gas atmosphere encased within a structure that provides adequate radiation shielding.

Systems that are used to store SNF for long periods of time in the dry state typically utilize a hermetically sealable and transportable canister or similar structure that serves as a vessel for the transfer and storage of the SNF. One such canister, known as a multi-purpose canister. ("MPC"), is described in U.S. Pat. No. 5,898,747, to Krishna P. Singh, issued Apr. 27, 1999, the entirety of which is hereby incorporated by reference. Typically, the SNF is loaded into an open canister that is submerged under water in a fuel pool. Once loaded with SNF, the canister is removed from the pool, placed in a staging area, dewatered, dried, hermetically sealed and transported to a storage facility. An example of a canister drying method can be found in U.S. Pat. No. 7,096,600, to Krishna P. Singh, issued Aug. 29, 2006, the entirety of which is hereby incorporated by reference. Because a typical canister does not by itself provide the necessary radiation shielding properties, canisters are often positioned within large storage containers known as casks/overpacks during all stages of transportation and/or storage. An example of a canister transfer and storage operation can be found in U.S. Pat. No. 6,625,246, to Krishna P. Singh, issued Sep. 23, 2003, the entirety of which is hereby incorporated by reference.

A dry storage canister ("DSC") provides the confinement boundary for the stored SNF. Thus, the structural and hermetic integrity of the DSC is extremely important. An existing DSC is sold in the United States by Transnuclear, Inc. of Columbia, Md. under the tradename NUHOMS. The NUHOMS DSC is a single-walled vessel with two top closure lids, including an inner top lid and an outer top lid. The closure lids are welded to a canister body after the SNF has been loaded into it. In the United States, the practice of using two closure lids to create a double confinement barrier only at the field welded closure location is motivated by the fact that field welds are generally less sound than those made in the factory.

However, in other countries, the creation of a double confinement barrier only at the field welded closure does not meet nuclear regulatory mandates. For example, Ukrainian regulatory practice calls for a double confinement boundary all around the SNF. To meet this dual-confinement requirement, the NUHOMS DSC comprises a hermetically-sealed fuel tube in which SNF rods in the form of a fuel bundle (half of a fuel assembly) is placed. These fuel tubes are positioned within the main cavity of the NUHOMS DSC. However, the body of the NUHOMS DSC remains a single-walled cylindrical vessel. The fuel tube concept of the NUHOMS DSC meets the basic Ukrainian regulation that a double confinement boundary exist all around the SNF. However, as will be discussed in greater detail below, it has been discovered that this design suffers from a number of significant drawbacks and engineering design flaws.

SUMMARY OF THE INVENTION

It is an object of the present invention to provide an apparatus for transporting, storing and/or supporting high level radioactive waste.

It is another object of the present invention to provide an apparatus for transporting, storing and/or supporting spent nuclear fuel.

A further object of the present invention is to provide and apparatus for storing spent nuclear fuel that essentially precludes the potential of radiological release to the environment.

A yet further object of the present invention is to provide an apparatus for storing, transporting and/or supporting spent nuclear fuel in a dry state.

Another object of the present invention is to create a system of storing spent nuclear fuel with two independent containment boundaries around the entirety of the spent nuclear fuel stored therein that contain radiological matter, such as gases and/or particulates.

A further object of the present invention is to provide an apparatus for storing spent nuclear fuel with two independent radiological containment boundaries that facilitate heat removal via conformal contact therebetween.

A still further object of the present invention is to provide a canister for storing spent nuclear fuel having two independent radiological containment boundaries surrounding a cavity.

Another object of the present invention is to provide an improved fuel basket for supporting spent nuclear fuel.

A still further object of the present invention is to provide a vented fuel tube for holding high level radioactive waste.

Yet another object is to provide a fuel basket that can efficiently accommodate both poison rods and spent nuclear fuel.

These and other objects are met by the present invention, which one aspect can be a canister for storing and/or transporting spent nuclear fuel rods comprising: a first shell forming a cavity for receiving spent nuclear fuel rods; a first plate connected to the first shell so as to form a floor of the cavity; a first lid enclosing the cavity; the first shell, the first plate and the first lid forming a first hermetic containment boundary about the cavity; a basket for supporting a plurality of spent nuclear fuel rods positioned within the cavity; a second shell surrounding the first shell so that an inner surface of the second shell is in substantially continuous surface contact with an outer surface of the first shell; a second plate connected to the second shell; a second lid; and the second shell, the second plate and the second lid forming a second hermetic containment boundary that surrounds the first radiation containment boundary.

In another aspect, the invention can be a canister apparatus for storing and/or transporting spent nuclear fuel rods comprising: a first pressure vessel comprising a first shell forming a first cavity for receiving spent nuclear fuel rods, a first plate connected to the first shell so as to enclose a first end of the first cavity, and a first lid connected to the first shell so as to enclose a second end of the first cavity; a second pressure vessel comprising a second shell forming a second cavity, a second plate connected to the second shell so as to enclose a first end of the second cavity, and a second lid connected to the second shell so as to enclose a second end of the second cavity; and the first pressure vessel located within the second cavity so that an inner surface of the second shell is in substantially continuous surface contact with an outer surface of the first shell.

In yet another aspect, the invention can be a canister apparatus for storing and/or transporting spent nuclear fuel rods comprising: a first metal pressure vessel having an outer surface and forming a cavity for receiving spent nuclear fuel rods; a second metal pressure vessel having an inner surface; and the first pressure vessel located within the second pressure vessel so that a substantial entirety of the outer surface of the first metal pressure vessel is in substantially continuous surface contact with the inner surface of the second metal pressure vessel.

in still another aspect, the invention can be a canister apparatus for storing and/or transporting spent nuclear fuel rods comprising: a first structural assembly forming a cavity for receiving spent nuclear fuel rods, the first structural assembly forming a first gas-tight containment boundary surrounding the cavity; a second structural assembly surrounding the first structural assembly, the second structural assembly forming a second gas-tight containment boundary surrounding the cavity; and wherein the first structural assembly and second structural assembly are in substantially continuous surface contact with one another.

In yet another aspect, the invention can be a basket apparatus for supporting a plurality of spent nuclear fuel rods within a containment structure comprising: a plurality of disk-like grates, each disk-like grate having a plurality of cells formed by a gridwork of beams; and means for supporting the disk-like grates in a spaced arrangement with respect to one another and so that the cells of the disk-like grates are aligned.

In a further aspect, the invention can be a basket apparatus for supporting a plurality of spent nuclear fuel rods within a containment structure comprising: a disk-like grate having a ring-like structure encompassing a gridwork of beams; the gridwork of beams comprising a first series of parallel beams, a second series of parallel beams and a third series of parallel beams; and wherein the first, second and third series of parallel beams are arranged in the ring-like structures so as to intersect and form a plurality of cells.

In another aspect, the invention can be a basket apparatus for supporting a plurality of spent nuclear fuel rods within a containment structure comprising: a disk-like grate having a ring-like structure encompassing a gridwork of beams; and the gridwork of beams forming a first set of cells having a first shape and a second set of cells having a second shape.

DETAILED DESCRIPTION OF THE INVENTION

Figure 1:
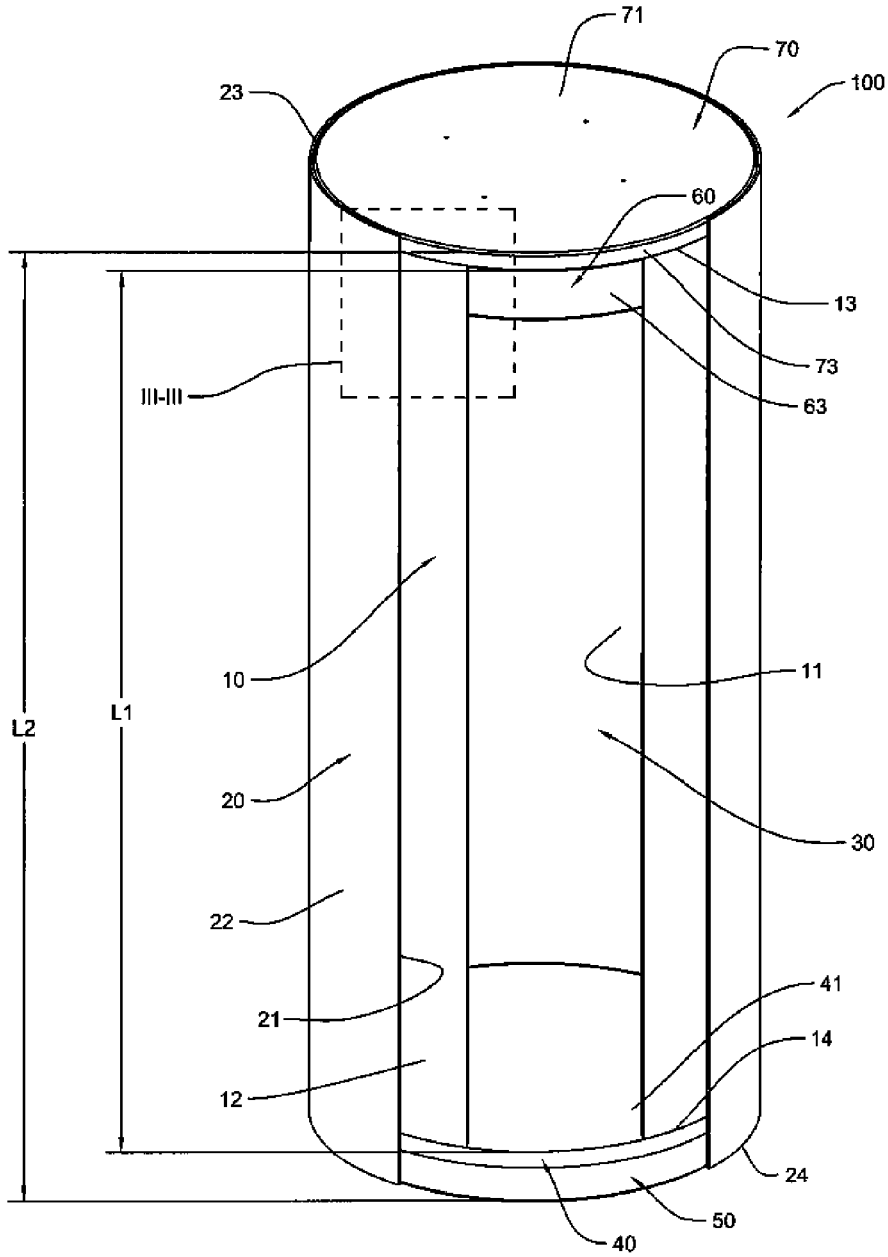
FIG. 1 is a top perspective view of a dual-walled DSC according to one embodiment of the present invention having a section cut-away.

Referring to FIG. 1, a dual-walled DSC 100 according to one embodiment of the present invention is disclosed. The dual-walled DSC 100 and its components are illustrated and described as an MPC style structure. However, it is to be understood that the concepts and ideas disclosed herein can be applied to other areas of high level radioactive waste storage, transportation and support. Moreover, while the dual-walled DSC 100 is described as being used in combination with a specially designed fuel basket 90 (which in of itself constitutes an invention), the dual-walled DSC 100 can be used with any style of fuel basket, such as the one described in U.S. Pat. No. 5,898,747, to Krishna P. Singh, issued Apr. 27, 1999. In fact, in some instances it may be possible to use the dual-walled DSC 100 without a fuel basket, depending on the intended function. Furthermore, the dual-walled DSC 100 can be used to store and/or transport any type of high level radioactive waste and is not limited to SNF.

As will become apparent from the structural description below, the dual-walled DSC 100 contains two independent containment boundaries about the storage cavity 30 that operate to contain both fluidic (gas and liquid) and particulate radiological matter within the cavity 30. As a result, if one containment boundary were to fail, the other containment boundary will remain intact. While theoretically the same, the containment boundaries formed by the dual-walled DSC 100 about the cavity 30 can be literalized in many ways, including without limitation a gas-tight containment boundary, a pressure vessel, a hermetic containment boundary, a radiological containment boundary, and a containment boundary for fluidic and particulate matter. These terms are used synonymously throughout this application. In one instance, these terms generally refer to a type of boundary that surrounds a space and prohibits all fluidic and particulate matter from escaping from and/or entering into the space when subjected to the required operating conditions, such as pressures, temperatures, etc.

Finally, while the dual-walled DSC 100 is illustrated and described in a vertical orientation, it is to be understood that the dual-walled DSC 100 can be used to store and/or transport its load in any desired orientation, including at an angle or horizontally. Thus, use of all relative terms through this specification, including without limitation "top", "bottom", "inner"and "outer", are used for convenience only and are not intended to be limiting of the invention in such a manner.

The dual-walled DSC 100 dispenses with the single-walled body concept of the prior art DSCs. More specifically, the dual walled DSC 100 comprises a first shell that acts as an inner shell 10 and a second shell that acts as an outer shell 20. The inner and outer shells 10, 20 are preferably cylindrical tubes and are constructed of a metal. Of course, other shapes can be used if desired. The inner shell 10 is a tubular hollow shell that comprises an inner surface 11, an outer surface 12, a top edge 13 and a bottom edge 14. The inner surface 11 of the inner shell 10 forms a cavity/space 30 for receiving and storing SNF. The cavity 30 is a cylindrical cavity formed about a central axis.

The outer shell 20 is also a tubular hollow shell that comprises an inner surface 21, an outer surface 22, a top edge 23 and a bottom edge 24. The outer shell 20 circumferentially surrounds the inner shell 10. The inner shell 10 and the outer shell 20 are constructed so that the inner surface 21 of the outer shell 20 is in substantially continuous surface contact with the outer surface 12 of the inner shell 10. In other words, the interface between the inner shell 10 and the outer shell 20 is substantially free of gaps/voids and are in conformal contact. This can be achieved through an explosive joining, a cladding process, a roller bonding process and/or a mechanical compression process that bonds the inner shell 10 to the outer shell 20. The continuous surface contact at the interface between the inner shell 10 and the outer shell 20 reduces the resistance to the transmission of heat through the inner and outer shells 10, 20 to a negligible value. Thus, heat emanating from the SNF loaded within the cavity 30 can efficiently and effectively be conducted outward through the shells 10, 20 where it is removed from the outer surface 22 of the outer shell via convection.

The inner and outer shells 10, 20 are preferably both made of a metal. As used herein, the term metal refers to both pure metals and metal alloys. Suitable metals include without limitation austenitic stainless steel and other alloys including Hastelloy™ and Inconel™. Of course, other materials can be utilized. The thickness of each of the inner and outer shells 10, 20 is preferably in the range of 5 mm to 25 mm. The outer diameter of the outer shell 20 is preferably in the range of 1700 mm to 2000 mm. The inner diameter of the inner shell 10 is preferably in the range of 1700 mm to 1900 mm. The invention, however, is not limited to any specific size and/or thickness of the shells 10, 20.

In some embodiments, it may be further preferable that the inner shell 10 be constructed of a metal that has a coefficient of thermal expansion that is equal to or greater than the coefficient of thermal expansion of the metal of which the outer shell 20 is constructed. Thus, when the SNF that is stored in the cavity 30 and emits heat, the outer shell 20 will not expand away from the inner shell 10. This ensures that the continuous surface contact between the outer surface 12 of the inner shell 10 and the outer surface 21 of the outer shell 20 will be maintained and a gaps will not form under heat loading conditions.

The dual-walled DSC 100 further comprises a first lid that acts as an inner top lid 60 for the inner shell 10 and a second lid that acts as an outer top lid 70 for the second shell 20. The inner and outer top lids 60, 70 are plate-like structures that are preferably constructed of the same materials discussed above with respect to the shells 10, 20. Preferably the thickness of the inner top lid 60 is in the range of 100 mm to 300 mm. The thickness of the outer top lid is preferably in the range of 50 mm to 150 mm. The invention is not, however, limited to any specific dimensions, which will be dictated on a case-by-case basis and the radioactive levels of the SNF to be stored in the cavity 30.

Figure 2:
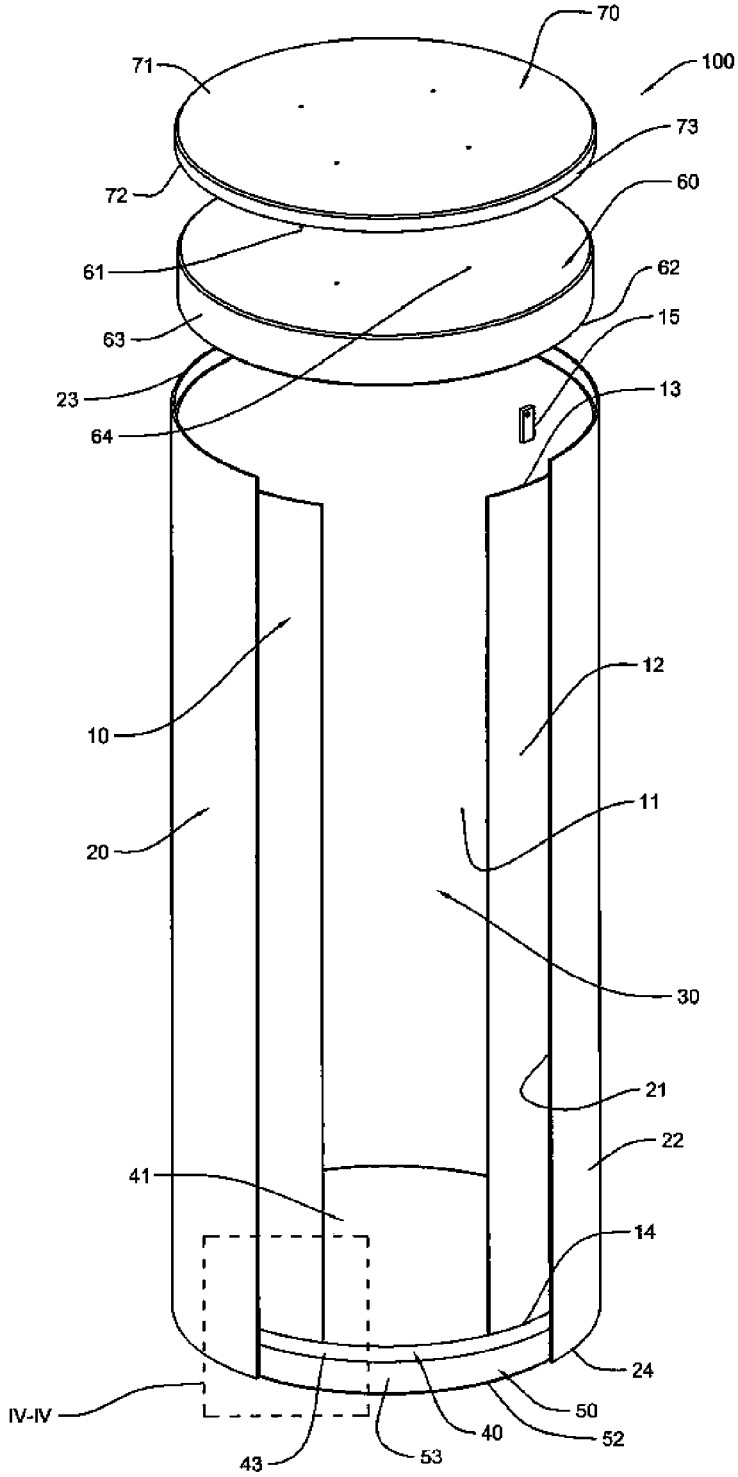
FIG. 2 is an exploded view of the dual-walled DSC of FIG. 1 showing the inner and outer top lids removed from the inner and outer shells.

Referring now to FIG. 2, the inner top lid 60 comprises a top surface 61, a bottom surface 62 and an outer lateral surface/edge 63. The outer top lid 70 comprises a top surface 71, a bottom surface 72 and an outer lateral surface/edge 73. When fully assembled, the outer lid 70 is positioned atop the inner lid 60 so that the bottom surface 72 of the outer lid 70 is in substantially continuous surface contact with the top surface 61 of the inner lid 60.

During an SNF underwater loading procedure, the inner and outer lids 60, 70 are removed. Once the cavity 30 is loaded with the SNF, the inner top lid 60 is positioned so as to enclose the top end of the cavity 30 and rests atop the brackets 15. Once the inner top lid 60 is in place and seal welded to the inner shell 10, the cavity 30 is evacuated/dried via the appropriate method and backfilled with nitrogen, helium or another inert gas. The drying and backfilling process of the cavity 30 is achieved via the holes 64 of the inner lid 60 that form passageways into the cavity 30. Once the drying and backfilling is complete, the holes 61 are filled with a metal or other wise plugged so as to hermetically seal the cavity 30.

Figure 3:
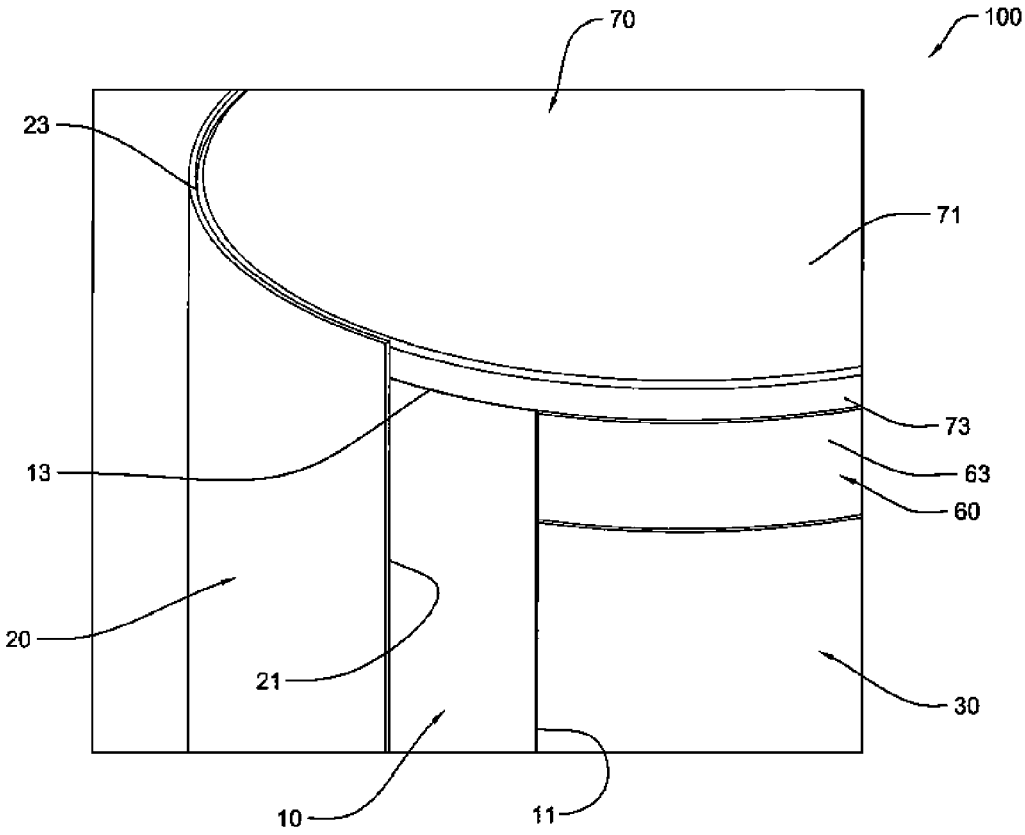
FIG. 3 is a close-up view of the area III-III of FIG. 1

Referring now to FIGS. 1 and 3 concurrently, the outer shell 20 has an axial length $L_2$ that is greater than the axial length $L_1$ of the inner shell 10. As such, the top edge 13 of the inner shell 10 extends beyond the top edge 23 of the outer shell 20. Similarly, the bottom edge 24 of the outer shell 20 extends beyond the bottom edge 13 of the inner shell 10.

The offset between the top edges 13, 23 of the shells 10, 20 allows the top edge 13 of the inner shell 10 to act as a ledge for receiving and supporting the outer top lid 70. When the inner lid 60 is in place, the inner surface 11 of the inner shell 10 extends over the outer lateral edges 63. When the outer lid 70 is then positioned atop the inner lid 60, the inner surface 21 of the outer shell 20 extends over the outer lateral edge 73 of the outer top lid 70. The top edge 23 of the outer shell 20 is substantially flush with the top surface 71 of the outer top lid 70. The inner and outer top lids 60, 70 are welded to the inner and outer shells 10, 20 respectively after the fuel is loaded into the cavity 30. Conventional edge groove welds can be used. However, it is preferred that all connections between the components of the dual-walled DSC 100 be through-thickness weld.

The dual-walled DSC 100 further comprises a first plate that acts as an inner base plate 40 and a second plate that acts as an outer base plate 50. The inner and outer base plates 40, 50 are rigid plate-like structures having circular horizontal cross-sections. The invention is not so limited, however, and the shape and size of the base plates 40, 50 is dependent upon the shape of the inner and outer shells 10, 20. The inner base plate 40 comprises a top surface 41, a bottom surface 42 and an outer lateral surface/edge 43. Similarly, the outer base plate 50 comprises a top surface 51, a bottom surface 52 and an outer lateral surface/edge 53.

The top surface 41 of the inner base plate 40 forms the floor of the cavity 30. The inner base plate 40 rests atop the outer base plate 50. Similar to the other corresponding components of the dual-walled DSC 100, the bottom surface 42 of the inner base plate 40 is in substantially continuous surface contact with the top surface 51 of the outer base plate 50. As a result, the interface between the inner base plate 40 and the outer base plate 50 is free of gaseous gaps/voids for thermal conduction optimization. An explosive joining, a cladding process, a roller bonding process and/or a mechanical compression process can be used to effectuate the contact between the base plates 40, 50. Preferably, the thickness of the inner base plate 40 is in the range of 50 mm to 150 mm. The thickness of the outer base plate 50 is preferably in the range of 100 mm to 200 mm. Preferably, the length from the top surface of the outer top lid 70 to the bottom surface of the outer base plate 50 is in the range of 4000 mm to 5000 mm, but the invention is in no way limited to any specific dimensions.

The outer base plate 50 may be equipped on its bottom surface with a grapple ring (not shown) for handling purposes. The thickness of the grapple ring is preferably between 50 mm and 150 mm. The outer diameter of the grapple ring is preferably between 350 mm and 450 mm.

Figure 4:
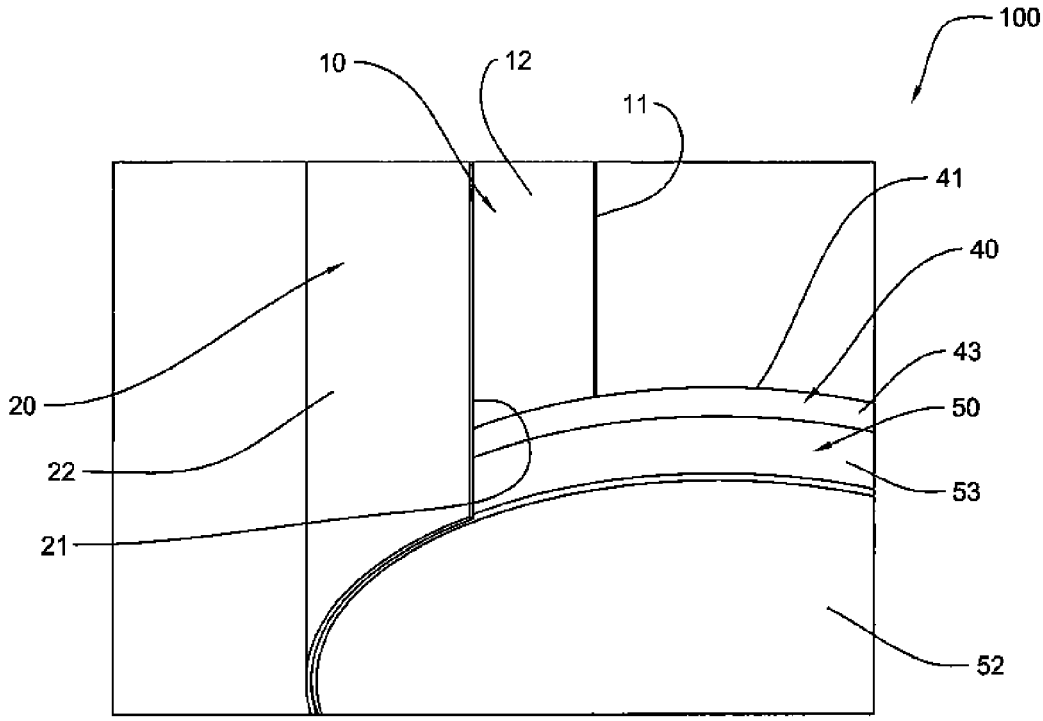
FIG. 4 is a close-up view of the area IV-IV of FIG. 2.

Referring now to FIGS. 2 and 4 concurrently, the inner shell 10 rests atop the inner base plate 40 in a substantially upright orientation. The bottom edge 14 of the inner shell 10 is connected to the top surface 41 of the inner base plate 40 by a through-thickness single groove (V or J shape) weld. The outer surface 12 of the inner shell 10 is substantially flush with the outer lateral edge 43 of the inner base plate 40. The outer shell 20, which circumferentially surrounds the inner shell 10, extends over the outer lateral edges 43, 53 of the inner and outer base plates 40, 50 so that the bottom edge 24 of the outer shell 20 is substantially flush with the bottom surface 52 of the outer base plate 50. The inner surface 21 of the outer shell 20 is also connected to the outer base plate 50 using a through-thickness edge weld. In an alternative embodiment, the bottom edge 24 of the outer shell 20 could rest atop the top surface 51 of the outer base plate 50 (rather than extending over the outer later edge of the base plate 50). In that embodiment, the bottom edge 24 of the outer shell 20 could be welded to the top surface 51 of the outer base plate 50.

When all of the seal welds discussed above are completed, the combination of the inner shell 10, the inner base plate 40 and the inner top lid 60 forms a first hermetically sealed structure surrounding the cavity 30, thereby creating a first pressure vessel. Similarly, the combination of the outer shell 20, the outer base plate 50 and the outer top lid 70 form a second sealed structure about the first hermetically sealed structure, thereby creating a second pressure vessel about the first pressure vessel and the cavity 30. Theoretically, the first pressure vessel is located within the internal cavity of the second pressure vessel. Each pressure vessel is engineered to autonomously meet the stress limits of the ASME Code with significant margins.

Unlike the prior art DSC, all of the SNF stored in the cavity 30 of the dual-walled DSC 100 share a common confinement space. The common confinement space (i.e, cavity 30) is protected by two independent gas-tight pressure retention boundaries. Each of these boundaries can withstand both sub-atmospheric supra-atmospheric pressures as needed, even when subjected to the thermal load given off by the SNF within the cavity 30.

Figure 5:
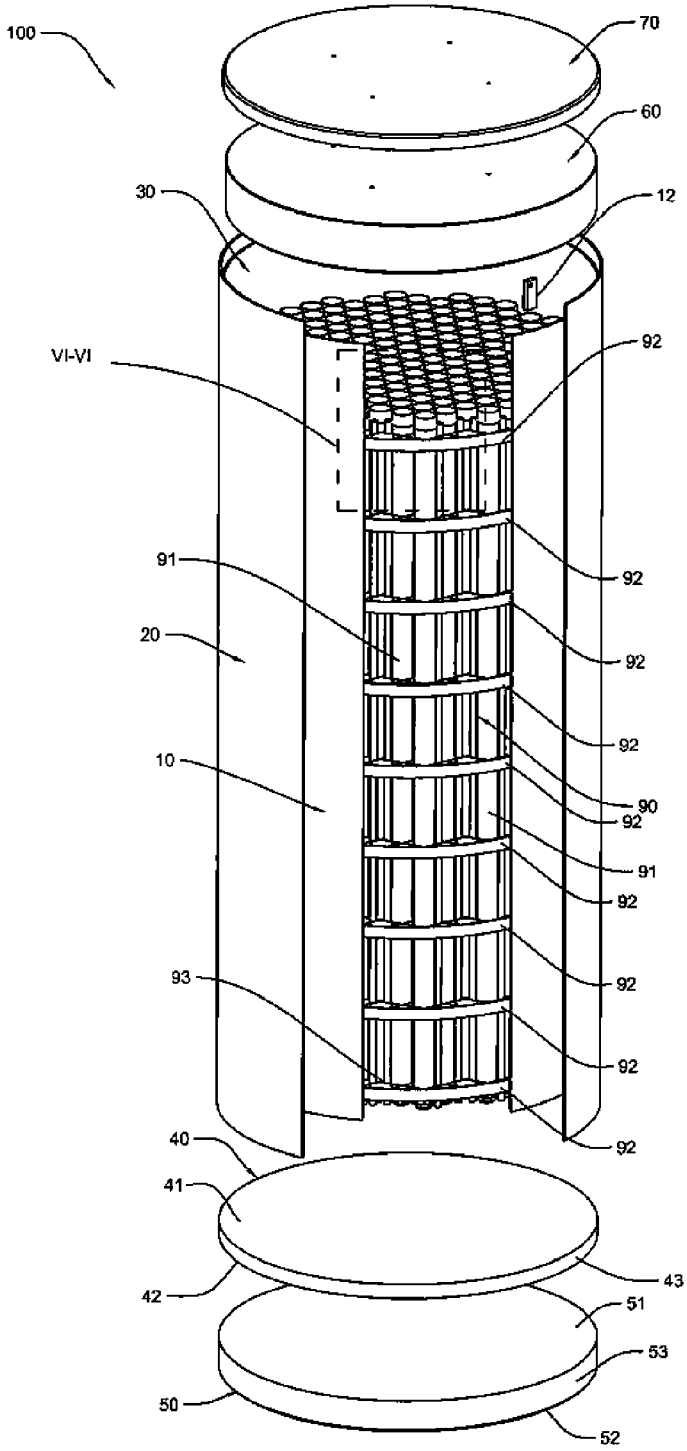
FIG. 5 is a perspective view of the dual-walled DSC of FIG. 1 having a section cut-away and having a fuel basket according to one embodiment of the present invention positioned within the storage cavity.

Referring now to FIG. 5, the dual-walled DSC 100 is illustrated having a fuel basket 90 positioned within the cavity 30 in a free-standing orientation. The fuel basket 90 serves to hold and support a plurality of SNF rods (which are located within fuel tubes 91) in the desired arrangement and maintains the desired separate locality. The fuel basket 90 comprises a plurality of disk-like grates 92 arranged in a stacked and spaced orientation. The separation between the disk-like grates 92 is accomplished via a plurality of vertically oriented tie-rods that pass through the cells of the disk-like grates 92. Once the tie rods are in place, one of the disk-like grates 92 is slid into position. Tubular sleeves that can not pass through the cells are then placed over the tie-rods and above the disk-like grates 92 in place. The next disk-like grates 92 is then slid down the tie rods. However, because the tubular sleeves can not pass through the disk-like grates 92, the two disk-like grates 92 are maintained in the spaced relation.

The grates 92 are disc-like frames comprising a ring 185 and a plurality of series of beams 182, 183, 184. The outer surface 186 of the ring 185 is in surface contact with the inner surface II of the inner shell 10. The outer diameter of the disk-like grate 92 is preferably 1700 mm to 1900 mm. The outer diameter, however is dependent upon the size of the cavity 30.

In the illustrated embodiment, the number of grates 92 is nine, and the thickness of each grate 92 is preferably between 1 mm and 10 mm. However, the invention is not so limited, so long as the SNF rods are adequately supported within the cavity 30.

Figure 6:
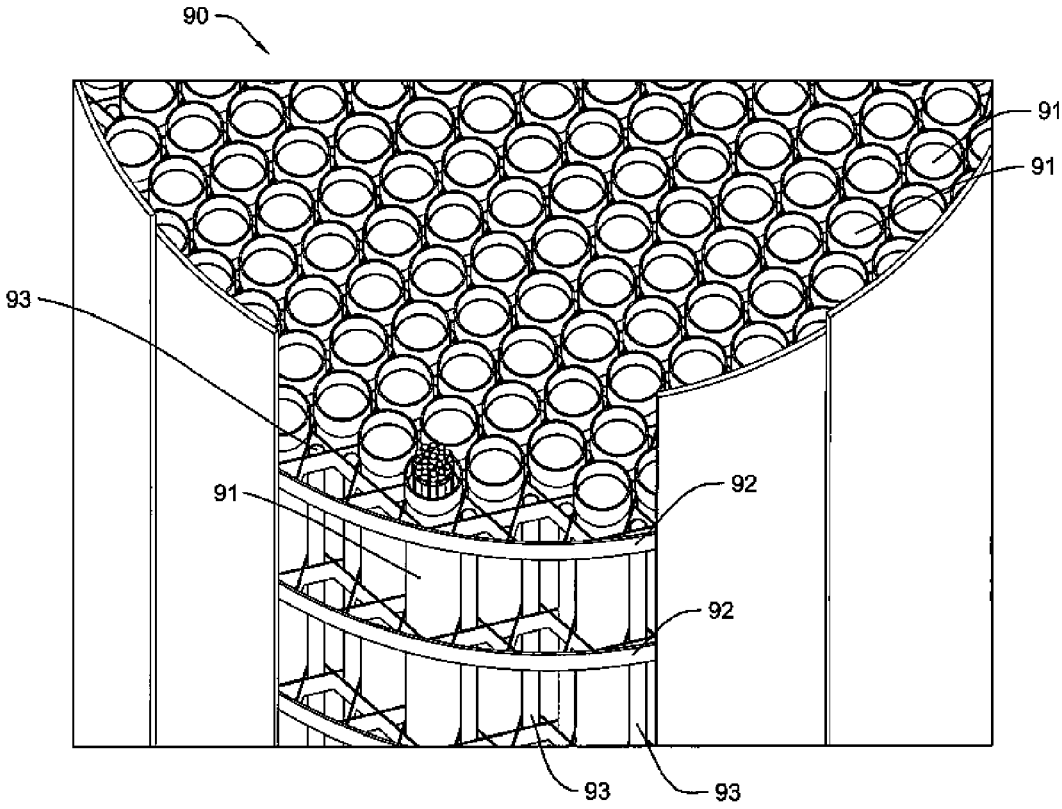
FIG. 6 is a close-up view of area VI-VI of FIG. 5.

Referring now to FIGS. 5 and 6, concurrently, the fuel basket 90 further comprises a plurality of ventilate fuel tubes 91. As will be discussed in greater detail below, when assembled, the ventilated fuel tubes 91 are inserted through the cells 180 of the stack of grates 92, which are aligned. The ventilated fuel tubes 91 form cylindrical cavities 193 (FIG. 9) in which the SNF rods will reside. Preferably, the fuel cells 180 around the outer perimeter of the grates 92 (i.e. the slots 180 nearest to the inner surface 11 of the inner shell 10) remain free of SNF rods.

Figure 7:
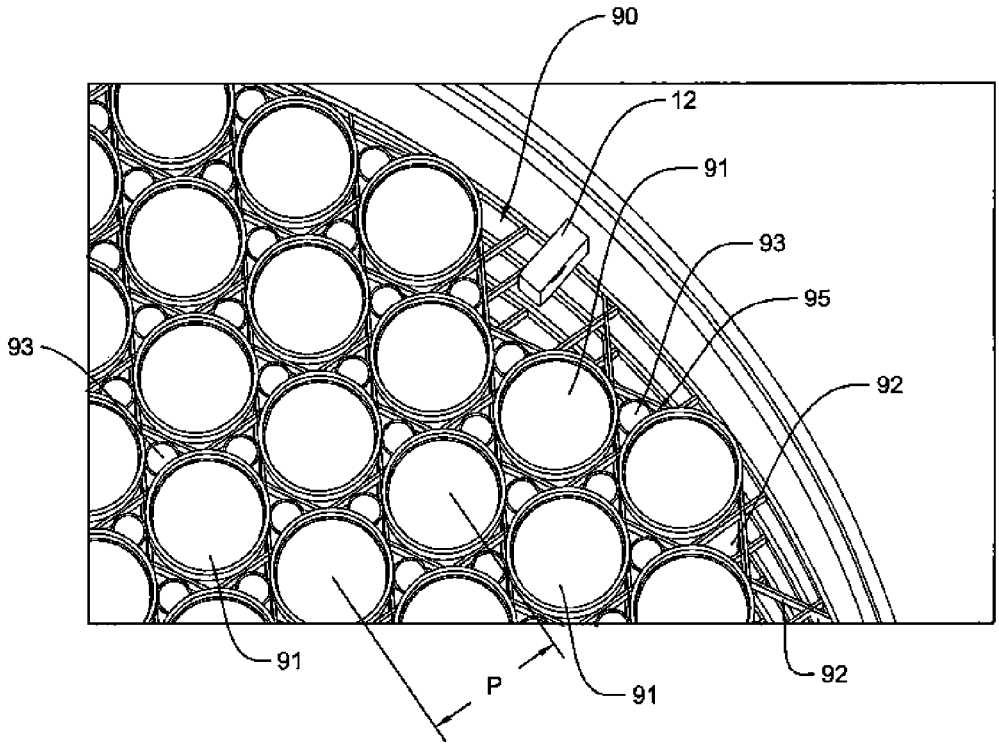
FIG. 7 is a top view of a portion of the dual-walled DSC of FIG. 5 with the lid assembly removed and fuel basket positioned therein.

Referring now to FIG. 7, the grates 92 also comprise a plurality of smaller cells 95 (referred to below as poison rod cells 181) for slidably receiving poison rods 93. The poison rods 93 are provided between the loaded fuel tubes 91 to control reactivity in necessary cases. The number of poison rods 93 is selected to ensure that the computed $k_{eff}$ of the SNF rods at maximum design basis initial enrichment, with no credit for burnup, and with the inclusion of all uncertainties and biases is less than 0.95. However, in some embodiments, the poison rods 93 may not be required at all.

The pitch P between each of the ventilated fuel tubes 91 is between 100 mm and 150 nm. The invention is not so limited however, and the pitch between the ventilated fuel tubes 91 is affected by both the size of the cavity 30 and the number and location of the poison rods 93, and the radioactivity of the load to be stored.

Figure 8:
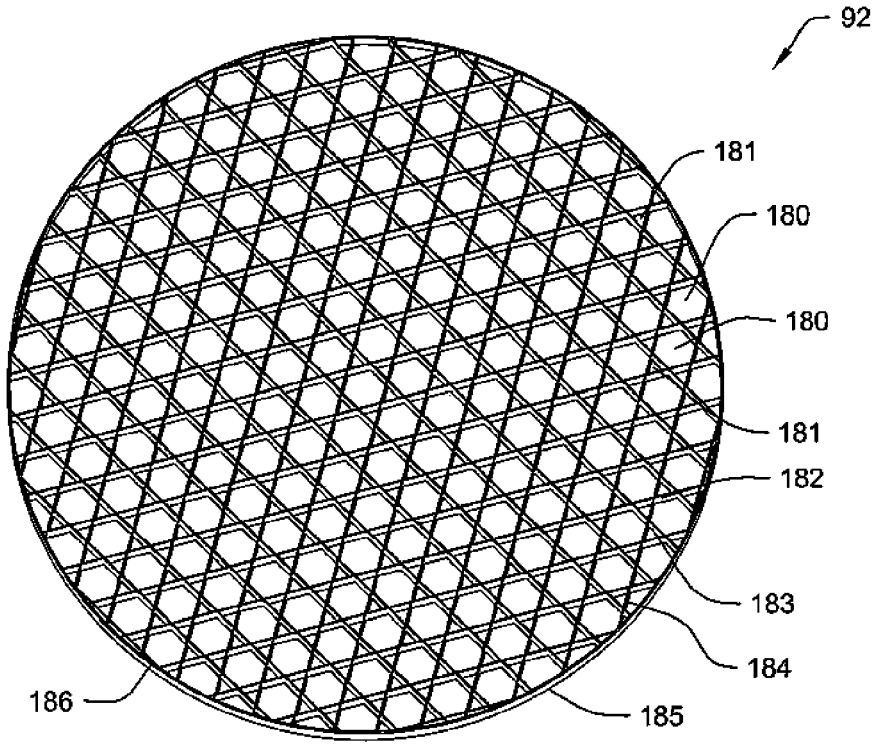
FIG. 8 is a top perspective view of the disk-like grate components of the fuel basket of FIG. 7 according to one embodiment of the present invention.

Referring now to FIG. 8, a top view of one of the grates 92 is illustrated. The grate 92 is a honey-comb grid like structure. The grates 92 comprise a ring structure 185, a first series of substantially parallel beams 182, a second series of substantially parallel beams 183 and a third series of substantially parallel beams 184. The ring structure 185 encompasses the a first, second and third series of substantially parallel beams 182-184. The entire grate 92 can be constructed of a metal, such as steel or aluminum, or any of the materials discussed above.

The first, second and third series of substantially parallel beams 182-184 are arranged within the ring structure 185 so that each one of the series of beams 182-184 intersects with the other two series of beams 182-184. The intersection of the series beams 182-184 forms a gridwork that results in an array of fuel cells 180 and an array of poison rod cells 181. More specifically, the general outline of the fuel cells 180 is created by the intersection of the first and second series of beams 182, 183 while the poison rod cells 181 are created by the intersection of the third series of beams 184 with the first and second series of beams 182, 183. When assembled, the fuel cells 180 receive the fuel tubes 91 while the poison rod cells 181 receive the poison rods 93. As can be seen the poison rod cells 181 are smaller and of a different shape than the fuel cells 180.

The relative arrangement of first, second and third series of substantially parallel beams 182-184 with respect to one another is specifically selected to create hexagonal shaped fuel cells 180 and triangular shaped poison cells 181. Of course, additional series of beams and/or arrangement can be used to create cells that have different shapes, including octagonal, pentagonal, circular, square, etc. The desired shape may be dictated by the shape of the fuel tube and SNF fuel assembly to be stored.

The series of beams 182, 183, 184 are rectangular strips (i.e., elongated plates) having notches (not visible) strategically located along their length to facilitate assembly. More specifically, notches that extend into the edges of the beams for at least ½ the height of the beams are provided. The notches are arranged on the beams 182-184 so that when the beams 182-184 are arranged in the desired gridwork, the notches of the bottom edge of some beams 182-184 are aligned with the notches on the top edge of the remaining beams 182-184. The beams 182-184 can then slidably mate with one another via the interaction between the notches.

The beams 182, 183, 184 are then welded to each other at their intersecting points via tungsten inert gas process. While the beams 182-184 are illustrated as strips, the invention is not so limited and other structures may be used to form the gridwork, such as rods.

Figure 9:
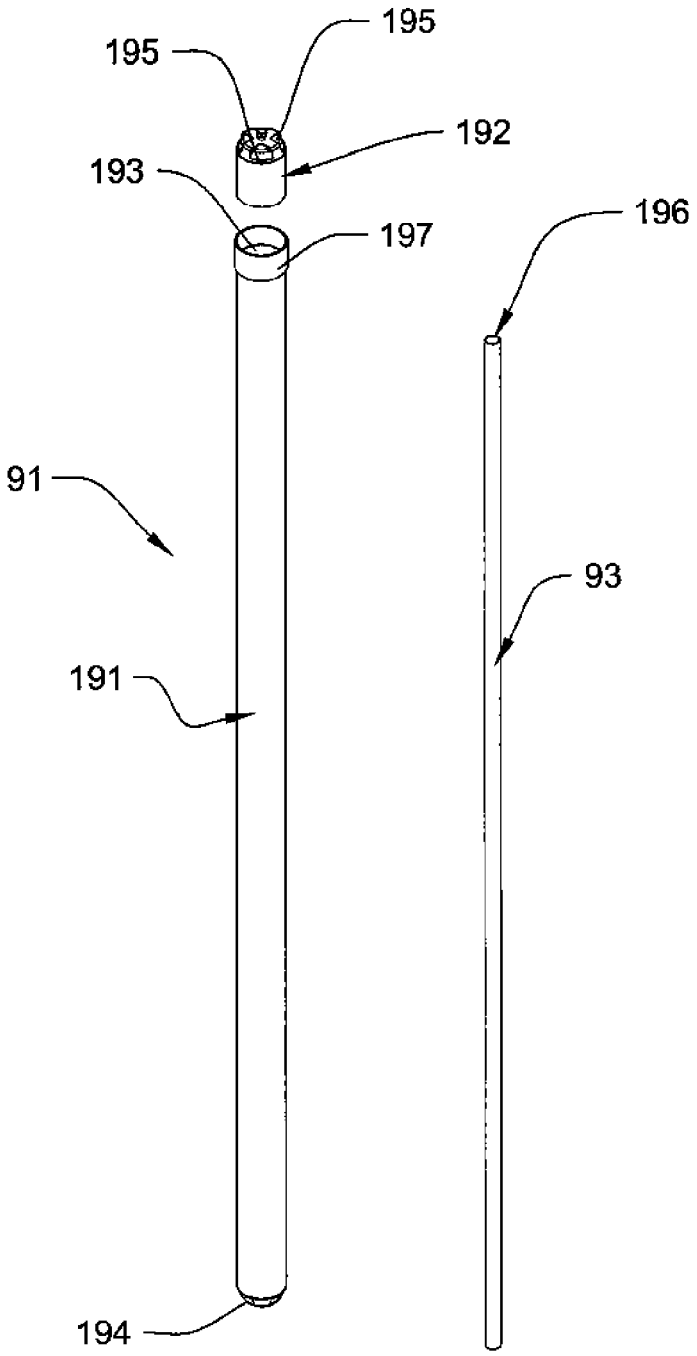
FIG. 9 is a perspective view of the ventilated fuel tube and the poison rod of the fuel basket assembly of FIG. 7 removed therefrom according to one embodiment the present invention.

Referring now to FIG. 9, the structure of the poison rods 93 and the ventilated fuel tubes 91 will be described. In the illustrated embodiment, the poison rods 93 are hollow tubular members having a cavity 196 for receiving a neutron absorbing material. For example, the hollow tubular member can be constructed of a stainless steel and filled with boron-carbide powder. In other embodiment, the poison rods 93 can be constructed of a monolithic material, such as a metal matrix material, such as metamic.

The outer diameter of the poison rods 93 is between 20 mm and 40 mm and the inner diameter is between 10 mm and 40 mm. The invention is not so limited, however. When assembled in the DSC 100, the poison rods 93 are of a sufficient length so as to extend along the full height of the SNF rods stored within the fuel tubes 91.

Turning now to the fuel tubes 91, the ventilated fuel tubes 91 are designed to allow for ventilation of heat emitted by the SNF rods stored therein. The ventilated fuel tube 91 comprises a tubular body portion 191 and a ventilated cap portion 192. The tubular body portion 191 forms a cavity 193 for receiving the SNF rods, e.g., in the form of fuel bundles (half fuel assemblies). Preferably, the ventilated fuel tubes 91 have a horizontal cross sectional profile such that the cavity 193 accommodates no more than one fuel bundle. However, this is not limiting of the invention. The outer and inner diameter of the tubular body portion 191 of the ventilated fuel tube 91 is preferably between 75 mm and 125 mm, but the invention is not so limited.

The tubular body portion 191 comprises a closed bottom end 194 and open top end 197. The closed bottom end 194 is a tapered and flat bottom. As will be discussed in further detail below, the tapering of the closed bottom end 194 allows for better air flow through the dual walled DSC 100. In an alternative embodiment, the closed bottom end 194 could further comprise holes and/or vents for improved air flow and heat removal. The ventilated cap portion 192 is connected to the open top end of the body portion 191 once the cavity 193 is filled with the SNF rods. The cap portion 192 is a non-unitary structure with respect to the tubular body 191 and removable therefrom. The caps 192 prevent any of the solid contents from spilling out during handling operations in the processing facility.

The caps 192 of the tubes 91 comprise one or more openings 195 that provide passageways into the cavity 193 from the cavity 30. The openings 195 are covered with fine-mesh screen (not visible) so as to prevent any build-up of pressure in the fuel tube 191 while containing any small debris within the cavity 193 of the tube 91. It has been discovered that one inherent flaw in the design of the NUHOMS DSC is that the hermetically sealed fuel tube creates a mini-pressure vessel around the SNF rods stored therein. Because of the small confinement space/volume available in the hermetically sealed fuel tube of the NUHOMS DSC, even a small amount of water or release of plenum gas from the inside of the SNF rods can raise the internal pressure in the fuel tube steeply, rendering it susceptible to bursting. As a result, the integrity of the fuel tube of the NUHOMS DSC as a pressure vessel can not be assured when used to store previously waterlogged SNF rods that contain micro-cracks with a high level of confidence. The ventilated fuel tubes 91 of the present invention, on the other hand, prevent pressure build-up by allowing ventilation with the larger cavity 30 via the opening 195 in the cap 192 The openings 195 are generally triangular in shape, but can be circular, rectangular or any other shape, so long as the proper venting is achieved.

Referring again to FIG. 5, when the ventilated fuel tubes 92 are positioned in the dual walled DSC 100, a plenum exists between the top of the ventilated fuel tubes 91 and the bottom surface 62 of the inner top lid 60. As mentioned previously, it is also preferable that the perimeter of the grid plate 92 remain free of fuel tubes 91.

Whereas the present invention has been described in detail herein, it should be understood that other and further modifications, apart from those shown or suggested herein, may be made within the spirit and scope of the present invention. It is also intended that all matter contained in the foregoing description or shown in any accompanying drawings shall be interpreted as illustrative rather than limiting.

What is claimed is:

1. A multi-purpose canister for storing and/or transporting radioactive materials comprising:

a first pressure vessel comprising a first shell forming a first cavity for receiving radioactive materials, a first plate connected to the first shell so as to enclose a first end of the first cavity, and a first lid directly connected to the first shell so as to enclose a second end of the first cavity;

a second pressure vessel comprising a second shell forming a second cavity, a second plate connected to the second shell so as to enclose a first end of the second cavity, and a second lid directly connected to the second shell so as to enclose a second end of the second cavity; and the first pressure vessel located within the second cavity and fixedly bonded to the second pressure vessel so that an inner surface of the second shell is in substantially conformal surface contact with a substantial entirety of an outer surface of the first shell.

2. The multi-purpose canister of claim 1 wherein the first pressure vessel is permanently bonded to the second pressure vessel.

3. The multi-purpose canister of claim 1 wherein the first shell and the second shell are constructed of a metal.

4. The multi-purpose canister of claim 3 wherein the first pressure vessel is fixedly bonded to the second pressure vessel by an explosive joining, a cladding process, a roller bonding process, a mechanical compression process, or a combination thereof.

5. The multi-purpose canister of claim 3 wherein the first shell is made of a metal having a first coefficient of thermal expansion and the second shell is made of a metal having a second coefficient of thermal expansion, wherein the first coefficient of thermal expansion is equal to or greater than the second coefficient of thermal expansion.

6. The multi-purpose canister of claim 1 further comprising:

an inner surface of the second plate being in substantially conformal surface contact with an outer surface of the first plate; and an inner surface of the second lid being in substantially conformal surface contact with an outer surface of the first lid.

7. The multi-purpose canister of claim 1 further comprising:

the first shell, the first plate, the first lid, the second shell, the second plate and the second lid constructed of a metal; and all connections between the first shell, the first plate and the first lid are accomplished via through-thickness welds; and all connections between the second shell, the second plate and the second lid are accomplished via through-thickness welds.

8. The multi-purpose canister of claim 1 further comprising:

the first pressure vessel having an outer surface and the second pressure vessel having an inner surface; and wherein the entirety of the outer surface of the first pressure vessel is in substantially conformal surface contact with the inner surface of the second pressure vessel.

9. The multi-purpose canister of claim 1 further comprising:

the first shell having a first edge, a second edge and a first axial length;

the second shell having a first edge, a second edge and a second axial length that is greater than the first axial length; and the first pressure vessel positioned within the second cavity so that the first and second edges of the second shell extend beyond the first and second edges of the first shell respectively.

10. The multi-purpose canister of claim 1 further comprising:

a plurality of elongated tubes located within the first cavity; and each of the elongated tubes comprising a tubular body forming a space for receiving radioactive materials and a ventilated cap having at least one hole forming a passageway from the first cavity into the space.

11. The multi-purpose canister of claim 10 further comprising a plurality of poison rods located within the first cavity between the elongated tubes.

12. The multi-purpose canister of claim 1 wherein the first and second shells are cylindrical and constructed of metal.

13. The multi-purpose canister of claim 1 wherein the first cavity comprises an inert gas atmosphere.

14. An apparatus for storing and/or transporting radioactive materials comprising:

a multi-purpose canister having a body comprising a first metal pressure vessel and a second metal pressure vessel;

the first metal pressure vessel having an outer surface and forming a cavity for receiving radioactive materials;

the second metal pressure vessel having an inner surface;

the first pressure vessel located within and fixedly bonded to the second pressure vessel so that a substantial entirety of the outer surface of the first metal pressure vessel is in substantially conformal surface contact with the inner surface of the second metal pressure vessel; and wherein the first metal pressure vessel is formed by a first set of structural components and the second metal pressure vessel is formed by a second set of structural components, the structural components of the first and second sets being mutually exclusive.

15. A multi-purpose canister for storing and/or transporting radioactive materials comprising:

a first structural assembly forming a cavity for receiving radioactive materials, the first structural assembly forming a first gas-tight containment boundary surrounding the cavity;

a second structural assembly surrounding the first structural assembly, the second structural assembly forming a second gas-tight containment boundary surrounding the cavity;

wherein the first structural assembly and second structural assembly are in substantially conformal surface contact with one another and fixedly bonded together; and wherein the first structural assembly is formed by a first set of structural components and the second structural assembly is formed by a second set of structural components, the structural components of the first and second sets being mutually exclusive.

16. An apparatus for storing and/or transporting radioactive materials comprising:

a multi-purpose canister having a dual-walled body comprising:

an inner wall comprising a first shell forming a cavity for receiving radioactive materials, a first plate connected to the first shell so as to form a floor of the cavity, a first lid enclosing the cavity and directly connected to the first shell, the first shell, the first plate and the first lid forming a first radiological containment boundary about the cavity;

an outer wall comprising a second shell surrounding the first shell so that an inner surface of the second shell is fixedly bonded to and in substantially conformal surface contact with a substantial entirety of an outer surface of the first shell, a second plate connected to the second shell, a second lid directly connected to the second shell, the second shell, the second plate and the second lid forming a second radiation containment boundary that surrounds the first radiological containment boundary; and a basket for supporting the radioactive materials, the basket positioned within the cavity.

17. The apparatus of claim 16 wherein the substantially conformal surface contact is achieved by a cladding process, a bonding process, or a combination thereof.

18. The apparatus of claim 16 wherein the first shell is made of a material having a first coefficient of thermal expansion and the second shell is made of a material having a second coefficient of thermal expansion, wherein the first coefficient of thermal expansion is equal to or greater than the second coefficient of thermal expansion.

19. The apparatus of claim 16 wherein the first shell has a first top edge, a first bottom edge and a first axial length; wherein the second shell has a second top edge, a second bottom edge and a second axial length that is greater than the first axial length so that the second top edge and the second bottom edge of the second shell extend beyond the first top edge and the first bottom edge of the first shell respectively.

20. The apparatus of claim 19 wherein the first bottom edge of the first shell is connected to a top surface of the first plate and wherein the outer surface of the first shell is substantially flush with an outer lateral edge of the first plate.

21. The apparatus of claim 20 wherein the inner surface of the second shell is connected to both an outer lateral edge of the first plate and an outer lateral edge of the second plate, and wherein the second bottom edge of the second shell is substantially flush with a bottom surface of the second plate.

22. The apparatus of claim 21 wherein the inner surface of the second shell is connected to an outer lateral edge of the second lid and wherein the second top edge of the second shell is substantially flush with a top surface of the second lid.

23. The apparatus of claim 22 wherein the inner surface of the first shell is connected to an outer lateral edge of the first lid, and wherein a top surface of the first lid is substantially flush with the first top edge of the first shell.

24. The apparatus of claim 23 further comprising a plurality of brackets for supporting the first lid, the brackets positioned in the cavity and connected to the inner surface of the first shell.

25. The apparatus of claim 23 wherein the second lid rests atop the first top edge of the first shell; and wherein an outer lateral edge of the second lid is connected to the inner surface of the second shell.

26. The apparatus of claim 23 further comprising:

all connections between the first shell, the first plate and the first lid are accomplished via through-thickness welds; and all connections between the second shell, the second plate and the second lid are accomplished via through-thickness welds.

27. The apparatus of claim 16 wherein a top surface of the second plate is in substantially conformal surface contact with a bottom surface of the first plate.

28. The canister apparatus of claim 1 wherein the second pressure vessel is a unitary structure extending from the second plate to the second lid.

29. The apparatus of claim 16 wherein the outer wall is a unitary structure extending from the second plate to the second lid.

* * * * *